United States Patent [19]

Martin et al.

[11] Patent Number: 5,039,395

[45] Date of Patent: Aug. 13, 1991

[54] STEAM-CRACKING IN A FLUID BED REACTION ZONE

[75] Inventors: Gérard Martin; Alain Feugier, both of Rueil-Malmaison; Germain Martino, Poissy, all of France

[73] Assignee: Institut Francais du Petrole, Rueil-Malmaison, France

[21] Appl. No.: 192,447

[22] Filed: May 11, 1988

[30] Foreign Application Priority Data

May 11, 1987 [FR] France ..... 87 06627

[51] Int. Cl.[5] ..... C10G 9/32

[52] U.S. Cl. ..... 208/127; 208/72; 208/99; 208/130; 208/132; 208/155

[58] Field of Search ..... 122/40; 431/7; 165/104.16; 110/245; 422/141, 142, 144, 145, 147; 208/73, 75, 113, 130, 153, 157, 127, 130, 99, 72, 155, 482

[56] References Cited

U.S. PATENT DOCUMENTS

| | | | |
|---|---|---|---|
| 3,113,985 | 12/1963 | Metrailer | 208/127 |
| 3,847,793 | 11/1974 | Schwartz et al. | 208/74 |
| 4,026,789 | 5/1977 | Janes | 208/74 |
| 4,385,985 | 5/1983 | Gross et al. | 208/113 |
| 4,405,444 | 9/1983 | Zandona | 208/113 |
| 4,437,979 | 3/1984 | Woebcke et al. | 208/127 |
| 4,490,241 | 12/1984 | Chou | 208/75 |
| 4,585,544 | 4/1986 | Gartside et al. | 208/75 |
| 4,668,378 | 5/1987 | Miyaschi et al. | 208/106 |
| 4,753,907 | 6/1988 | Zandona et al. | 208/73 |
| 4,853,105 | 8/1989 | Herbst et al. | 208/72 |
| 4,861,458 | 8/1989 | Martin et al. | 208/73 |

*Primary Examiner*—Anthony Mc Farlane

*Attorney, Agent, or Firm*—Millen, White & Zelano

[57] ABSTRACT

The invention is directed to steam-cracking in a fluid bed reaction zone, of a charge of hydrocarbons having at least two carbon atoms per molecule.

In this process the charge (3) circulates with steam (2) and inert solid particles, heated at a temperature $T_1$ from 500° to 1,800° C., through at least one enclosure (7). A gas effluent is separated from the particles in the enclosure and fed to a quenching zone (8) opening into said enclosure. Said effluent is circulated with cooling second solid particles which are at a temperature $T_2$ lower than $T_1$ and at most equal to 800° C. A steam-cracking effluent is then recovered through line (15).

This process can be used in petrochemistry, particularly for producing ethylene and propylene.

16 Claims, 4 Drawing Sheets

STEAM-CRACKING IN A FLUID BED REACTION ZONE

The invention concerns an improved process for hydrocarbon steam cracking in a fluid bed reaction zone, destined to produce light olefins, more particularly ethylene and propylene. It also concerns a device for carrying out this process.

BACKGROUND OF THE INVENTION

Steam cracking appeared as early as 1920 for producing ethylene from ethane. It became very soon a basic process in petrochemistry for treating heavier and heavier charges which may be as heavy as vacuum gas-oils.

It is based on the relative instability at high temperature of paraffins and naphthenes as compared with olefins and aromatics. The main reactions involved are the breaking of a C-C bond by a homolytic breaking mechanism, giving an olefin and a paraffin, and dehydrogenation. Both reactions are endothermic and hence favored by a temperature increase. They also result in an increase of the number of molecules present and they are accordingly favored by low partial pressures of hydrocarbons to be treated. For this reason said pressure is reduced to a maximum extent by adding steam to the reaction medium.

However, it has been observed that, when a hydrocarbon charge is maintained at a temperature higher than 800° C. for about a few tenths of second, coke deposits are quickly formed, resulting in several disadvantages: decrease of the heat transfer between the reactor and the charge to be cracked, substantial increase of the reactor wall temperature, and a decrease of the useful sectional area of the reactor resulting in an increase of the pressure drop inside the reactor, making necessary the shut down of the unit for coke removal.

Coke formation is due to secondary reactions such as the formation of condensed polycyclic aromatic hydrocarbons, as well as to the polymerization of the olefins formed.

This last reaction results from the tendency of olefins to polymerize at a temperature of about 500–600° C. It is thus advisable, for decreasing the extent of said secondary reaction, to subject the reaction effluents to a quick cooling (often called "quenching") so as to bring them quickly from the pyrolysis temperature to a temperature lower than 500° C., generally by indirect heat exchange means.

It has been further observed that the olefin polymerization was favored by the presence, at the surface of the heat exchanger metal walls, of nickel which acts as polymerization heterogeneous catalyst (M. DENTE and coll., "Fouling of transferline exchangers in ethylene plants", AICHE Meeting of Houston, Tex., Mar. 30, 1983).

Thermodynamic and kinetic surveys of hydrocarbon pyrolysis reactions have thus indicated that the selectivity to olefin production can be increased by the following operations:

quick temperature increase of the charge up to the optimum pyrolysis temperature for a given charge, said temperature being maintained as constant as possible in the reaction zone, decrease of the charge residence time in the reaction part, decrease of the hydrocarbon charge partial pressure, quick and efficient quenching of the reaction effluents for avoiding secondary reactions of the type of olefin polymerization.

Technologically, these required operations are conveniently conducted according to a general process comprising the steps of:

a) preheating the charge, diluted with steam, b) heating this mixture at high temperature in tubular furnaces in order to limit the hydrocarbon residence time during this pyrolysis phase, c) quickly quenching the reaction effluents.

The technology development essentially concerned the pyrolysis step (b) and the quenching step (c), in order to fulfill the above-mentioned requirements and to treat a variety of charges presently extending from ethane to vacuum gas-oils.

The steam cracking furnaces were improved essentially for reducing the residence time and the pressure drop, by decreasing the length of the tubular reactors, thus increasing the thermal flow, particularly near the reactor feeding port.

Moreover, for reducing corrosion phenomena to a minimum, the furnaces must be heated by means of fuels of high quality, of low sulfur content, such for example as natural gas or fuel-gas produced by steam-cracking itself, thus increasing the operating cost of the process.

With respect to the quenching of the effluent reaction products, the technology was oriented towards heat exchangers provided with transfer lines for the pyrolysis reaction effluents (called TLX exchangers, "transfer line exchangers" disclosed for example in U.S. Pat. No. 4,097,544).

The object of these exchangers is to produce, as quickly as possible, a sharp decrease of the pyrolysis reactor gas effluents at such temperatures that secondary reactions of olefin polymerization type do not occur.

However, the temperature of the output effluent of the quench exchanger varies in accordance with the steam-cracked charge. For example, when treating vacuum gas-oils of aromatic type, a relatively high amount of condensed polyaromatic fuel-oils, present in the steam-cracking effluents, cannot be quenched at low temperature without giving rise to excessive clogging of the exchanger, liable to reduce the operating time of the furnace. Here, two-step cooling is generally preferred, the first step being performed by indirect quenching in the quench exchanger down to a temperature of about 450–500° C. and the second step consisting of direct cooling by introduction of cold liquids in the exchanger effluents.

An attempt was made by manufacturers of "TLX" type exchangers for reducing the dead volume between the tubular reactor outputs and the effluent inputs in the quench exchanger (without complete success), which is detrimental to a quick quenching. In addition, these exchangers are built of refractory steel containing nickel which is an olefin polymerization catalyst.

None of the known techniques for hydrocarbons steam cracking is, to the best of our knowledge, fully satisfactory. In particular, even with the use of special alloys such for example as INCOLOY 800 H for the tubular furnaces, it is not possible to exceed a reaction temperature of about 1,100° C. and hence to quickly bring the charges to temperatures at which thermal cracking is performed in good conditions. Moreover, it is known that the maximum heat amount must be supplied to the tubular reactor zone where the C—C bond cracking and dehydrogenation drogenation endothermic reactions take place, but this is not satisfactorily achieved in the known processes.

On the other hand, the requirement of maintaining high thermal flow has been met by reducing the cross-section of the pyrolysis tubes, making a decrease of their length in order to maintain an acceptable pressure drop. Moreover, none of the present processes is operable with a substantially constant temperature all along the reaction zone. In addition, the heterogeneity of the thermal flow results in substantial temperature differences at the outer surface of each tube.

Steam cracking processes of the prior art, not operated in tubular reactors, are disclosed for example in U.S. Pat. No. 4,411,769 where, in an integrated ,coking and steam cracking process, it is suggested to use very hot coke particles of sufficient temperature to supply the heat necessary for the endothermic steam cracking reaction.

The prior art is also illustrated by U.S. Pat. No. 4,370,303 which discloses a steam cracking process where the charge is cracked in the presence of steam by contact with hot solid particles in a first portion of a reaction zone, the obtained effluent is then separated from the hot particles in a primary separation zone and then in a separation zone of cyclone type.

It is then subjected to quenching by contact with cold particles in a second portion of the reaction zone separate from the first one.

But the step of contacting hot particles with the charge, the primary separation step and the cyclone separation step are performed in different enclosures, thus resulting in increased engineering cost and in substantial lengthening of the total residence time of the effluent before cooling, independently from that concerning the passages from one enclosure to another through the transfer lines.

The technological background is further illustrated by European patents 154,385 and 226,483, British patent 709,583, U.S. Pat. No. 2,846,360 and French patent 2,576,546.

SUMMARY OF THE INVENTION

The object of the present invention is to provide a process coping with these various disadvantages and adapted for the steam cracking of a hydrocarbon (or a hydrocarbon mixture) comprising at least two carbon atoms, giving improved yield of ethylene and propylene as compared with the previous processes.

The invention concerns more particularly a process for the steam cracking, in a fluid bed reaction zone, of a hydrocarbon charge containing at least two carbon atoms per molecule, comprising a step of heating said charge in a first portion of said reaction zone by contact with first hot solid particles, said heating step giving a first gas effluent. The process further comprises a step of cooling said effluent by contact with cooling (or cold) solid particles in a second portion of said reaction zone. This process is characterized in that said first part of the reaction zone comprises at least one enclosure having a central axis and an internal periphery, in that a mixture of said charge, at least partly vaporized with steam, is circulated at the internal periphery of said enclosure, wherein said mixture is contacted with said first solid particles, heated to a temperature $T_1$ from 500° to 1800° C., said mixture and said solid particles circulating co-currently as a whole, downwardly or upwardly, in that, after stirring of at least the hot solid particles with said mixture, said particles are separated in said enclosure from a least a portion of said first gas effluent resulting from said stirring, at least a part of said effluent is fed to the second part of said reaction zone, said second part of the reaction zone being a cooling zone comprising a discontinuous tubular zone, the discontinuous portion opening into said enclosure substantially along its central axis, said effluent is contacted with said cooling solid particles which are circulated through said second part of the reaction zone and whose temperature $T_2$ is at most 800° C., said temperature $T_2$ being lower than temperature $T_1$, said second particles being separated from a second steam cracking effluent resulting from the contact of said first effluent with said second solid particles, and the steam cracking effluent recovered.

The process according to the invention offers the advantage of bringing the mixture to the optimum steam cracking temperature in a minimum time, of maintaining said temperature in the enclosure as constant as possible for a very short time and of efficiently and quickly quenching the steam cracking effluents. The density of thermal flow is very high in view of the direct gas-particles contact, over a very large surface, which is the total surface of all the particles.

In addition, the high turbulence inherent in the enclosure hydrodynamics (cyclone of substantially circular cross-section with helical flow and with or without spiral reversal) provides for very high transfer coefficients favoring the charge thermal flash and for a high separation efficiency. Generally 0.05 to 0.5% of the hot particle flow is recovered in the cooling zone. By this type of enclosure where the various steps of the process are performed it is possible to control and limit to very short periods the residence time of the steam-cracked products, thus reducing to a minimum the parasitic steam-cracking reactions. It further provides for very short contact of the effluents with the particles to be quenched, which is thus achieved according to a rectangular profile and not stepwise as in the prior art (U.S. Pat. No. 4,370,303).

According to a first embodiment of the process, the first hot solid particles used for heating the mixture and the second cold solid particles used for cooling the steam-cracking effluent may circulate co-currently, downwardly or upwardly. The cooling zone is correspondingly adapted to a downward flow(see FIG. 1)or to an upward flow of the cold particles and of the effluent the cooling zone and the contact zone of the hot solid particles with the mixture being generally at vertically opposite poles of the enclosure.

According to a second embodiment of the process, the first hot solid particles and the second cold particles may circulate counter-currently. For example (see FIG. 2), the hot solid particles and the mixture first circulate downwardly and then the gas effluents and the cold particles follow an upward path through the cooling zone. Alternately, the hot solid particles and the mixture may flow upwardly through the enclosure whereas the gas effluents and the cold catalytic particles follow a downward path through the cooling zone. In both arrangements with counter-current circulation, the cooling zone and the zone of contact between the mixture and the hot solid particles are generally located substantially at the same end part of the enclosure.

As a general rule, the first hot solid particles and the second cold solid particles are substantially inert. Their size is generally from about 20 to 2000 microns, preferably from about 50 to 300 microns, and their density is about from 500 to 6,000 kg/m$^3$, preferably from 1,500 to 3,000 kg/m$^3$. These hot or cold particles are preferably the same, with the advantage of avoiding any problem of contamination between a population of a loop with that of another loop.

The solid particles used for heating or cooling generally have a specific surface lower than 100 m$^2$/g (determined by the so-called BET method, using nitrogen adsorption) preferably lower than 50 m$^2$/g and more preferably lower than 30 m$^2$/g. Their catalytic activity is low (for example lower than 10%, the value of 100% corresponding arbitrarily to the usual average activity of a cracking catalyst). Since they are rather inexpensive, it is recommended to discharge a part thereof from time to time and to replace it with the same amount of fresh particles when, after a time, they appear to be polluted.

The particles of hot or cold solids are generally selected from the group formed of calcite, dolomite, limestone, bauxite, barium hydroxide, chromite, magnesia, perlite, alumina and silica of low specific surface.

However, according to a particularly advantageous embodiment, the cold particles may contain a catalyst amount corresponding to 2–95%, preferably 10–50% and more particularly 12 to 45% by weight of the total fraction of cold particles, thus providing for a controlled and increased selectivity to the desired product, for example propylene.

The catalyst optionally added to the particles used for cooling the charge might be selected for example from the catalysts adapted to produce the metathesis of an internal olefin with ethylene. Generally these catalysts comprise basically compounds of molybdenum, tungsten, vanadium, niobium, tantalum or rhenium deposited on a matrix of silica, alumina, silica-alumina, zirconium oxide, thorium oxide etc . . . This catalyst is adapted to the final distribution of the steam-cracking effluents. These catalyst particles may have a size ranging from 20 to 2,000 microns, advantageously from 50 to 500 microns. They usually have a specific surface higher than 100 m$^2$/g (BET method) and, among them, those having a good thermal stability in the presence of steam are advantageously used.

The temperature of the first heating solid particles is usually from about 500° to 1,800° C., advantageously from 800° to 1,300° C., whereas the temperature of the second cooling particles is usually from about 200° to 800° C., advantageously from 300° to 600° C.

In the presence of a catalyst, the temperature of the cooling particles may be so adapted that the reaction temperature of the gas effluent gives the desired selectivity, this temperature adaptation being obviously concomitant with the adjustment of other important parameters such as the steam/charge ratio or the temperature of the heating particles.

According to a characteristic feature of the invention, the contact of said mixture with said first particles may be conducted in a zone of said enclosure substantially upstream the inlet of the second part of said reaction zone, i.e. of the steam-cracking effluent cooling zone.

More in detail, the process according to the invention comprises the following steps of:

introducing said first hot particles in a stream of steam adapted to impart to the particles a velocity from 10 to 80 m/s, advantageously 15–30 m/s and to produce an helical flow of said first solid particles in said enclosure, introducing at least a part of said charge into said enclosure by spraying or atomization, when the charge is still liquid after preheating, or through nozzles, for example when the charge is in gaseous state, so that the output velocity of the charge is about 10 to 150 m/s, advantageously about 50 to 100 m/s, the steam amount for stripping said first particles being such that the steam to charge flow rate ratio is about 0.1 to 2, preferably about 0.3 to 0.8, maintaining the obtained mixture in said enclosure for a residence time if about 0.1 to 2 s at a temperature $T_3$ about 500° to 1,500° C., preferably from 700° to 1,100° C., separating said first particles from said gas effluent and feeding the latter to the second part of said reaction zone wherein said second cooling particles are circulated in a stream of carrier gas (steam for example) adapted to convey the particles at a velocity from about 0.5 to 10 m/s, advantageously from 2 to 5 m/s, maintaining said gas effluent in said second part of the reaction zone for a residence time from about 0.1 to 100 s at a temperature $T_4$ from 300° to 600° C., and separating from said second steam-cracking effluent said second particles which are recovered.

By separation of the first particles from the gas effluent in the enclosure, it is meant a conventional separation and a separation by stripping. The hydrocarbon flow towards the regenerator stripped by these particles during said total separation step may amount to 0.01–0.5% of the total charge flow rate, which is particularly advantageous.

With an upward flow of particles the use of a carrier gas is not strictly necessary since the particles first fall by gravity and are then stripped by the gas effluents to be cooled.

According to another characteristic feature of the invention, at least one fluid bed regeneration of the first solid particles may be performed with the double effect of removing at least a part of the coke deposited on said particles during the steam cracking reaction and of heating said particles. If necessary, said particles may be further heated by combustion of an auxiliary fuel introduced substantially at the bottom of a first regeneration zone in order to perform its combustion by stages all along said zone. The regeneration of the first particles is performed at a temperature from 500° to 1,800° C. in the presence of oxygen- or of a molecular oxygen-containing gas. Then the major part of the regenerated particles and combustion gases is separated and at least a part of said regenerated solid particles is recycled to said enclosure, the hot solid particles being withdrawn from the regeneration stage without being fed back to said enclosure.

In another preferred embodiment, said regeneration and said heating of said first particles are conducted in at least two stages, a first stage in a substantially vertical elongated tubular zone having a L/D ratio (L being the length of the tube and D its diameter) ranging from 20 to 400, at a temperature $T_5$ from 500° to 1,500° C., by means of an oxygen- or molecular oxygen-containing carrier gas, followed with a second regeneration of heating particles and optionally with the completion of the auxiliary fuel combustion, in a second zone by means of an oxygen- or molecular oxygen-containing carrier gas at a temperature $T_6$ higher than $T_5$ and ranging from about 700° to 1,800° C.

According to another characteristic feature of the invention, said second cold particles which have been heated by contact with a gas effluent are generally cooled at a temperature from about 200° to 800° C. in at least one fluid bed cooling zone, downstream from said enclosure, for example in the tubular cooling zone and/or in the separation zone of the particles from the steam cracking effluent.

Examples of fuels useable to bring the hot solid particles to a sufficient temperature are those having an initial boiling point of about 400° C., particularly heavy fuels, straight-run residues or asphalts, i.e. fuels which may contain heteroatoms such as sulfur, nitrogen and heavy metals and which have the particular advantage of being inexpensive as compared with fuels of good quality required in the conventional heating system of steam-cracking processes for reducing the corrosion of the heating tubular chemical reactors. Alternately, petroleum cokes, coals or related products such for example as lignite, peat or mixtures thereof, can be used.

An adsorbent may be introduced together with the fuel in order to desulfurize in situ the combustion effluents, when the particles temperature is appropriate therefor, particularly when the regeneration temperature in the storage zone is lower than 1,000° C. This adsorbent may be a calcium-containing compound such as limestone, dolomite, calcite, alone or in association with other inert particles.

The hydrocarbon charges treated according to the invention generally comprise saturated aliphatic hydrocarbons such as ethane, alkane mixtures or oil cuts such as naphtha, straight-run gas-oils and vacuum gas-oils of final distillation point of about 570° C. Oil cuts may have been optionally subjected to a pretreatment such for example as a hydrotreatment. The charge may be preheated before being contacted with the particles, for example at 250° C.

The invention also concerns a device for carrying out the process, illustrated by FIG. 1, and which comprises :

at least one enclosure (7) of cyclone type, comprising a central axis and an inner periphery, inlet means (4) (*3b* FIG. 4) for a liquid or gaseous charge, either upstream from the enclosure and connected thereto or in the enclosure, said inlet means comprising means for spraying or atomizing (50 FIG. 4) said charge towards the inlet of said enclosure when it is liquid or conventional introduction means such as nozzles when the charge is in gaseous state, inlet means (2) for steam, upstream from said charge inlet means, adapted for the stripping of said first hot particles towards said enclosure (7), inlet means (6) for said first hot solid particles imparting thereto an helical motion at the inner periphery of said enclosure (7) in the direction of the charge and steam resultant flow, means (*7b*, 23) for separating solid particles from a first gas effluent in said enclosure (7), means (25), connected to said separation means, for conveying said first solid particles towards at least one regeneration means (26), and optionally heating means (29) for said solid particles, storage means (27) and means (31,32),connected to said regeneration means(26), for recycling said solid particles towards said enclosure (7), and optionally heating means (29), for said solid particles, inlet means (*8a*) for introducing second cold solid particles into said enclosure (7), at least one inlet means (9) for introducing said gas effluent and the second cold solid particles into a cooling reactor comprising of a tubular elongate and substantially vertical column (8) opening inside said enclosure substantially along its central axis, with co-current circulation of the first gas effluent and of the second cold solid particles either downwardly (dropper) or upwardly (riser), means for separation by stripping (10, 11) of a second steam-cracking effluent from the cold solid particles at said end of the column opposite to the end wherethrough said gas effluent and said cold solid particles have been introduced, means (12) for cooling said second cold solid particles in said column and/or in said separation means (10, 11), outlet means (15)for the second steam-cracking effluent, connected to said separation means (10, 11), means (16) connected to said separation means, for conveying the second cold solid particles to storing means (18), and means (22) for recycling at least a portion of said second particles to said cooling reactor.

According to an alternative embodiment of the apparatus, the cooling zone, for example the ascending zone (riser) comprises an upper part of diameter R containing said cooling means and a lower part of diameter r, opening into the enclosure substantially along its central axis, such that the R/r ratio be in the range from about 1 to 10. This configuration has the advantage of reducing the steam consumption required for stripping the particles to the inlet of the cooling reactor, so as to provide exchange surfaces in the reactor whereby an homogeneous cooling of the steam-cracking effluent and of the second particles can be performed in the same zone and the stripping of said second particles outside the reactor can be limited, thus avoiding the need for substantial recycling.

BRIEF DESCRIPTION OF THE DRAWINGS

The invention will be better understood from the description of a few embodiments, given by way of illustrative but non limiting examples, with reference to the accompanying drawings wherein.

DETAILED DESCRIPTION OF THE DRAWINGS

Figure 1:
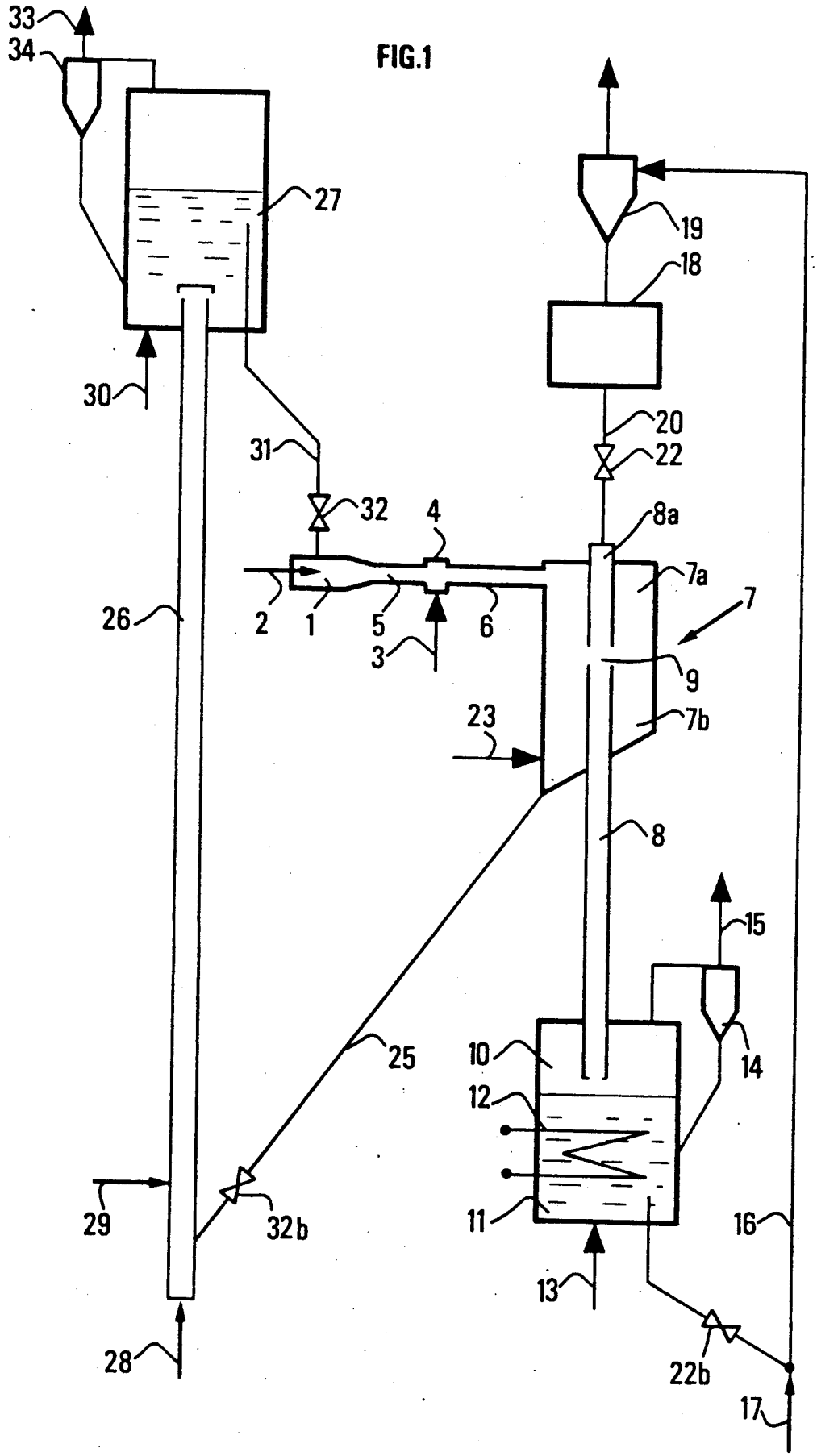
FIG. 1 illustrates an embodiment of steam-cracking process according to the invention where a charge and steam mixture and first hot solid particles circulate as a whole downwardly, co-currently with second solid particles adapted to cool the steam-cracking effluent.

In FIG. 1, the first hot and substantially inert solid particles originating from the heating zone are introduced in ejector 1 where they are suspended in and speeded up by a stream of steam, introduced through line 2. The charge, preheated for example at about 250° C., is conveyed through line 3 and introduced into the suspension through a device 4. This device 4 may consist merely of a ring provided with feeding or spraying orifices surrounding tube 5 where the steam-hot particle suspension flows. The very quick heating of the charge by the hot particles up to the steam-cracking temperature generally takes place in line 6 and the steam-cracking reaction develops essentially in the upper part 7*a* of enclosure 7 which is a cyclone of Uniflow type, substantially of circular cross-section, with direct passage and helical flow without reversal of the effluent gas spiral. The reaction temperature is maintained substantially constant at said level.

In said enclosure 7 the particles are progressively separated from the gas effluents by centrifugal effect and fall by gravity in the lower part 7*b* of the Uniflow cyclone. Steam used for desorbing the hydrocarbons fixed onto the particles is supplied through line 23 to the lower part 7*b* of the enclosure. The gas effluent, substantially free of hot particles, flows, through inlet means 9 comprising at least one orifice, into the upper part of a descending cooling column (dropper) 8 opening into enclosure 7, substantially along the axis thereof.

These gas effluents are quickly contacted with second cold solid particles, for example substantially inert, supplied at the upper part 8*a* of dropper 8. The effluents circulate co-currently with said cold solid particles in column 8.

The lower end of said column opens into an enclosure 10 where the steam-cracking effluent and the second particles are separated, essentially by gravitational and inertial effect.

These particles fall into a fluidized bed 11 at the lower part of enclosure 10. This fluidized bed is equipped with tube exchangers 12, known per se, which lower the temperature of the particles. It is fluidized by steam supplied through line 13 under conditions adapted to produce an efficient stripping of the hydrocarbons adsorbed on the particles or which might be driven along with the flow of cold particles. A cyclone 14, associated to enclosure 10, provides for an efficient gas-solid separation before transfer of the steam-cracking effluents towards a later treatment stage, through line 15.

The cooled particles, whose flow is controlled by a valve 22*b*, are then lifted through line 16, fed with carrying steam through line 17, to a storage bin (18), optionally operated in fluidized bed and equipped, if necessary, with exchange surfaces for a further cooling of the particles. These particles pass through a cyclone 19 where they are separated from the carrying steam. The storage bin 18 feeds dropper 8 through line 20. The flow rate of cooling solids is controlled by valve 22, whereby the intensity of the heat exchange may be modified.

The first hot solid particles, free of steam-cracking hydrocarbons are conveyed through line 25 and valve 32*b* to the lower part of a regeneration and optionally heating assembly comprising a lift 26 and a storage fluidized bed 27. This lift comprises a substantially vertical tubular column whose L/D ratio advantageously ranges from 30 to 200. It provides for the partial combustion of the deposited coke or of hydrocarbons of the charge which were not steam-cracked, thus providing simultaneously for the heating and the regeneration of the hot particles.

When the heat released by combustion of the coke deposited on the particles is insufficient to increase the temperature to the required level, it is possible to supply an auxiliary fuel through line 29 to the bottom of lift 26, substantially above the particle feeding line and to burn it by additional air, fed through line 28. This mode of introduction of the fuel provides for a good mixing thereof with the hot particles and for a combustion by stages which is always advantageous when the fuels are difficult to burn.

The lift 26 opens into enclosure 27, where the combustion of the coke deposited on the particles and the combustion of the auxiliary fuel are completed, in fluidized bed, by means of additional air fed through line 30. This enclosure 27 also operates as storage means for the particles before their introduction into the steam-cracking zone. This return to the steam-cracking zone is achieved through line 31 and valve 32 controlling the flow of heating solids. The heating and regeneration effluents are separated from the hot particles and discharged through line 33 after passage through a cyclone 34 associated to the storage and regeneration enclosure.

Figure 2:
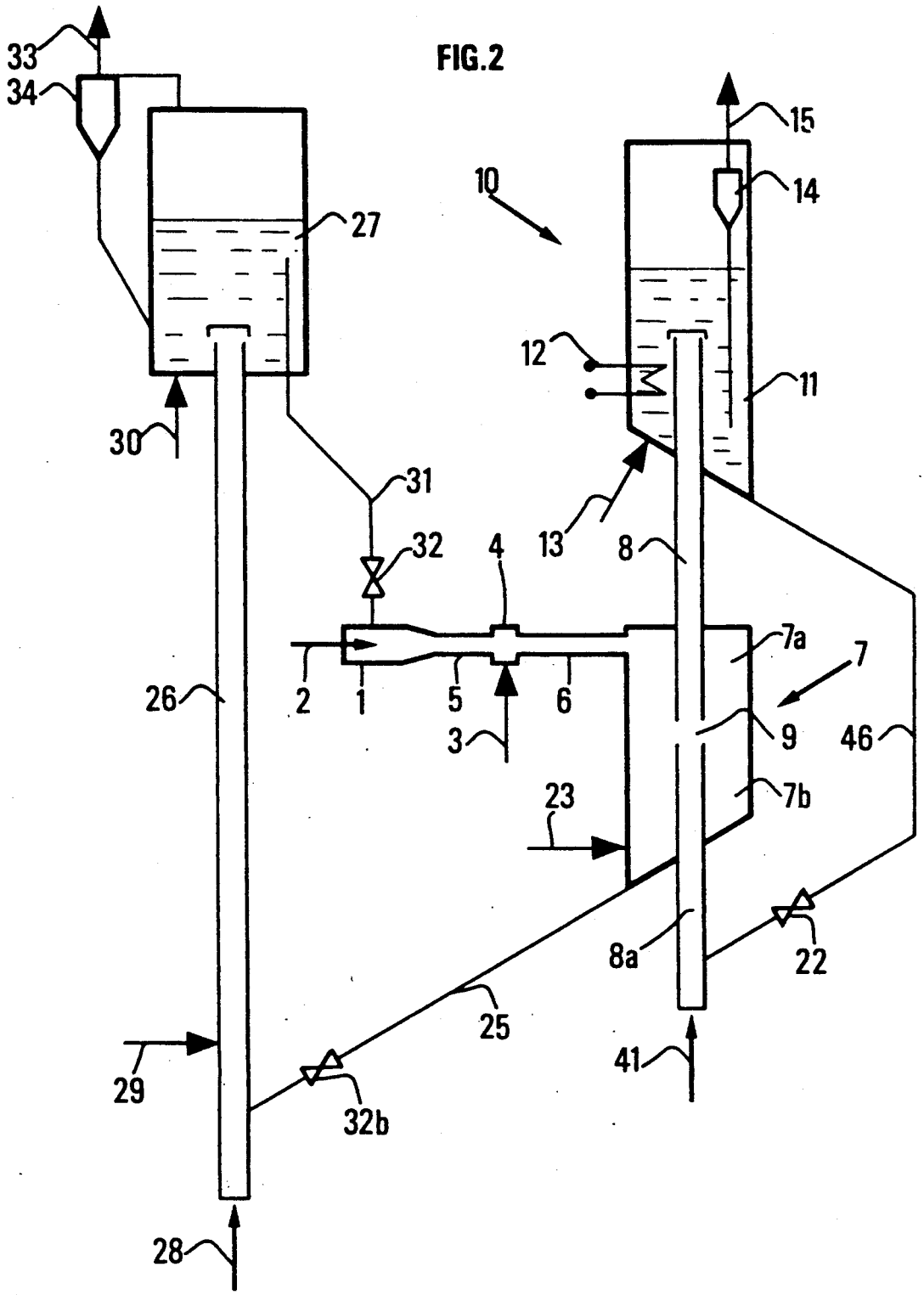
FIG. 2 illustrates another embodiment where the downward flow of the above mixture and first particles is in counter-current of the second particle flow.

FIG. 2 illustrates the embodiment of the invention where the cooling column is a riser.

The references of FIG. 2 are the same as those of FIG. 1 when designating the same parts.

The mixture heating and hot particle regeneration loop is strictly identical to that of FIG. 1.

The gas effluent, which has been cracked in the upper part 7*a* of enclosure 7 is separated from the hot particles in the lower part 7*b* where the particles are also stripped by steam supplied through line 23. It enters cooling column 8 through inlet means 9. The second cooling solid particles are conveyed through line 46 from the storage enclosure 10 to the lower part 8*a* of column 8, opening into the lower part of enclosure 7 along the axis thereof. Steam or recycled light hydrocarbons fed through line 41 are used to fluidize the particles in the cooling loop. The gas effluent is cooled for the most part in column 8 and enters the separation and storage enclosure 10 where it is separated and desorbed from the particles by means of steam supplied through line 13, which also maintains the fluidization. A cyclone 14 associated to the storage enclosure is used to complete the separation of the steam-cracking effluents, which are recovered through line 15.

A heat exchanger 12 in and/or around the storage enclosure 10 is used to withdraw heat accumulated by the cooling particles during the effluent cooling. The particles are then recycled through line 46 and valve 22 which controls their flow rate in the column.

Figure 3:
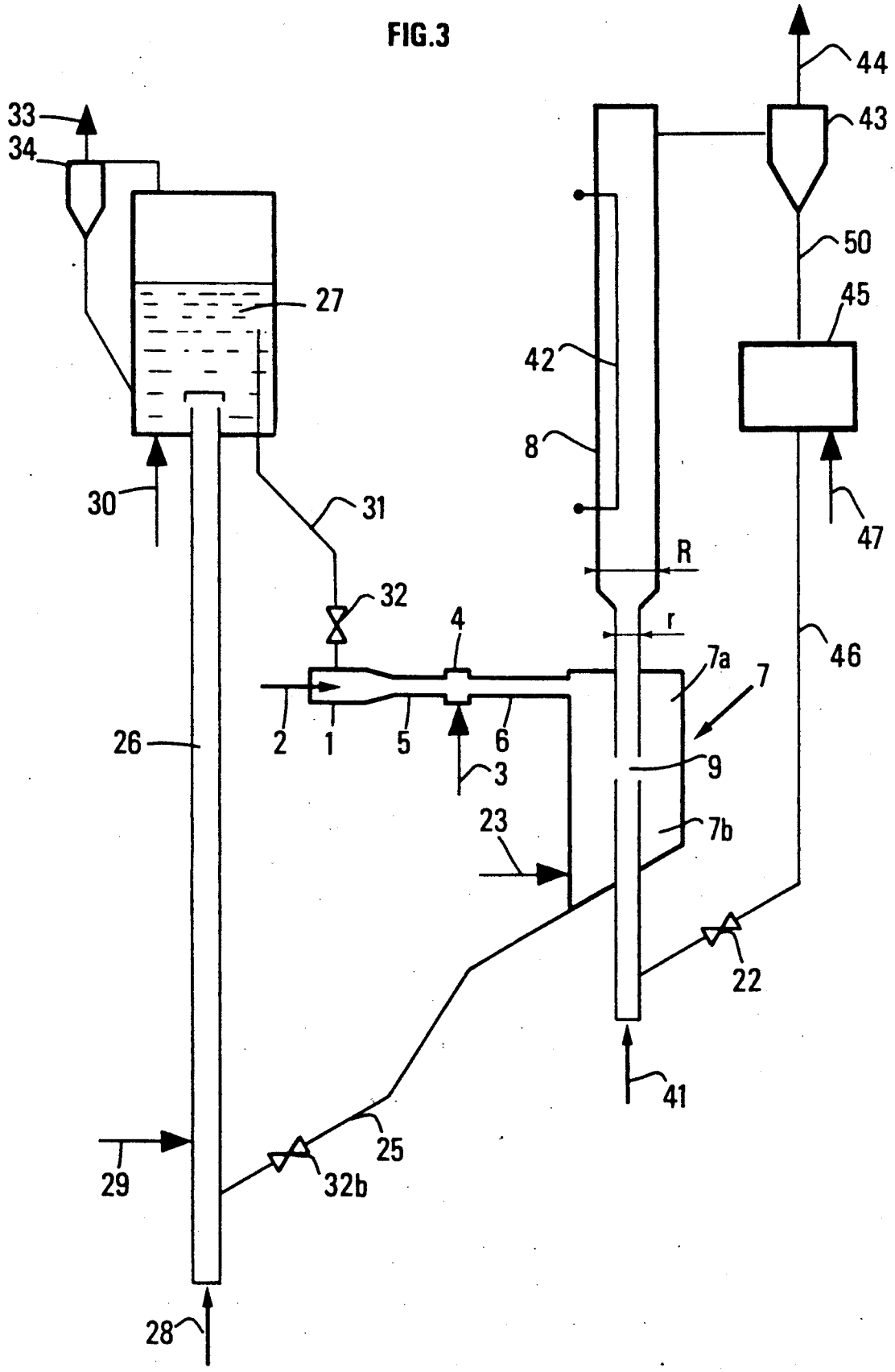
FIG. 3 illustrates an alternative embodiment of the ascending cooling zone.

An alternative embodiment illustrated in FIG. 3 comprises a cooling riser 8 whose upper part (defined as being the part above enclosure 7), of diameter R, contains cooling means 42 (for example wall exchange surfaces such as disclosed in French patent 2 575 546). This diameter R is from 2 to 4 times the diameter r of said column in enclosure 7. In these conditions, column 8 provides for the cooling of both the steam-cracking effluent and the effluent of cooling particles. The apparatus is accordingly simplified since high flow rates of solid particles can be avoided in the recycling part.

The solid particles driven along by the hydrocarbon stream from the upper part of column 8 are recovered in a cyclone 43 and conveyed to the storage bin 45. The steam-cracking effluent is recovered through line 44, connected to cyclone 43. A complementary stripping step with steam, supplied to bin 45 through line 47, desorbs the particles, and the desorbed effluents are recovered through another line (not shown in the figure).

The particles are then recycled through line 46 to the cooling column 8 and their flow rate is controlled by valve 22.

Generally, the pressures in the different enclosures are so adjusted as to maintain in enclosure 7 a pressure higher than that of the cooling zone in column 8, so as to limit the passage of cooling, inert and/or catalytic particles towards enclosure 7.

Figure 4:
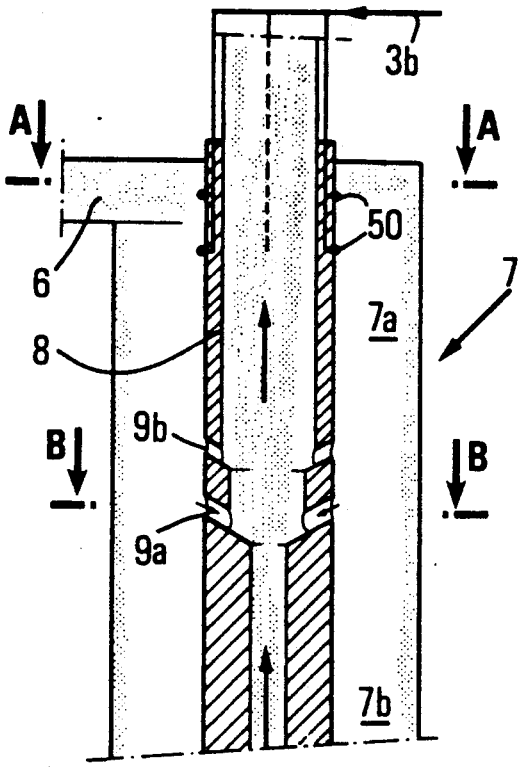
FIG. 4 is a longitudinal view of the reaction zone adapted for cooling in an ascending column.
Figure 5:
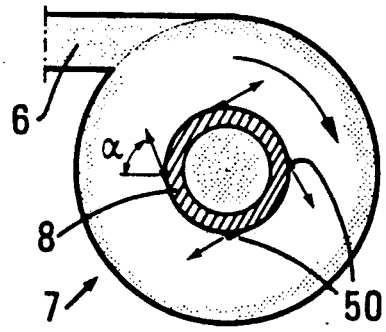
FIGS. 5 and 6 are views of cross-sectional cuts along planes AA' and BB' of FIG. 4, respectively at the introduction level of the charge and of the first hot solid particles and at the feeding level of the gas effluent into the cooling zone.

FIG. 4 is a more detailed view of cyclone 7, at the level of the upper zone 7*a*, where steam-cracking is performed by contact with hot solid particles, and at the level of the gas effluent inlet zone into the cooling riser. According to a particular embodiment, the charge, optionally preheated, fed through line 3*b*, is divided and injected by means of at least one set of atomization or spraying injectors 50 when in liquid state or by conventional means of the art when in gaseous state, these means being arranged on the external, e.g. cylindrical wall of the cooling column 8. These injectors may be distributed along a circle perpendicular to the column axis or along an helix. They are generally so arranged as to distribute the charge to be vaporized as uniformly as possible on the hot solids entering the cyclone and which circulate at high velocity along its periphery. The size of the charge droplets (when the charge is liquid) generally ranges from 10 to 300 microns. The input flow velocity into the cyclone and the ejection velocity of the charge are usually so adjusted as to substantially vaporize the droplets before they strike the hot solids covering the wall. As shown in FIG. 5, the injectors may be placed in the upper part 7*a* of cyclone 7, so as to advantageously propel the charge in the direction of flow of the spiral at an angle of about 0° to 80° with respect to the tube radius passing through the injector and preferably at an angle from about 30° to 60°, with a velocity generally from 10 to 150 m/s, preferably 30–80 m/s, towards the hot solid particles, which are tangentially admitted into cyclone 7 at a velocity generally from 10 to 80 m/s, preferably from 20 to 40 m/s.

The inlet for the gas effluents in the cooling zone may be provided at least at one level 9*a* and advantageously at least at two levels 9*a* and 9*b* of the cooling column 8, so that these effluents be better distributed over the cooling particles. Column 8*a* and column 8 are preferably of substantially the same external diameter. According to a preferred but not limitative embodiment and with respect to an upward flow of the cooling particles, the internal diameter of the column, downstream level 9*a*, is higher than upstream said level and lower than the diameter downstream level 9*b*. This arrangement favors the high velocity of the cooling particles and limits their escape towards the cyclone. It also provides for a better contact between hydrocarbons and particles.

Figure 6:
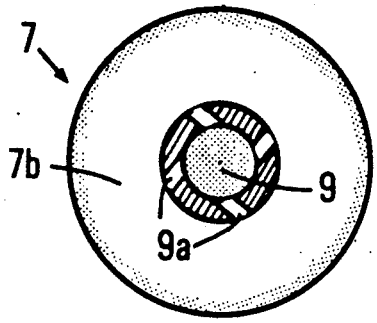

According to an advantageous embodiment of the invention, the openings 9*a*, 9*b* are beveled so that the effluents keep at the inlet the circular motion and the high velocity imparted thereto in the cyclone (FIG. 6). Said openings are advantageously oriented downwardly so as to favor the contact of the two phases.

Figure 7:
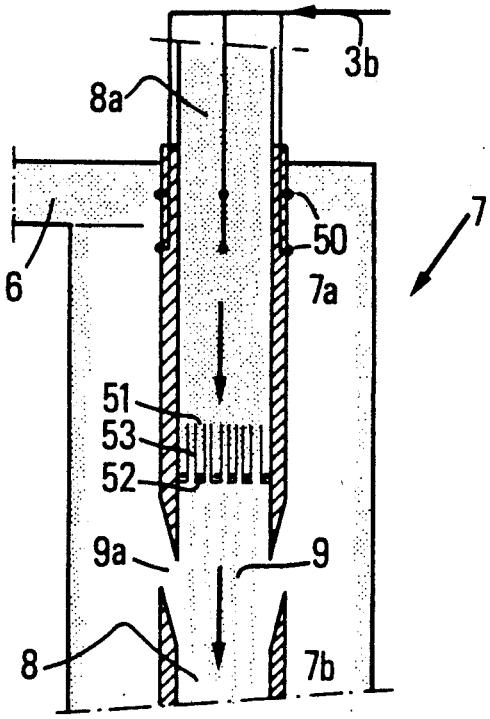
FIG. 7 illustrates another mode of admission of cold particles into the cooling zone.

FIG. 7 illustrates another admission mode of the cooling particles into enclosure 7, which is applicable to the steam-cracking loop illustrated in FIG. 1, i.e. in cyclones with or without spiral reversal and with a cooling dropper 8.

In FIG. 7, duct 8, supplying the cooling particles, passes through the upper part of cyclone 7, substantially along the central axis thereof, and is innerly arranged so as to convey the particles towards the median zone 7*b* of the cyclone, where they are contacted with the gas effluents. As a matter of fact, the cold particles fall in bed 51, fluidized by steam or light hydrocarbons ($C_1$ to $C_3$) introduced through sparged-tubes 52. Then, the particles, by overflow in gutters 53, uniformly distributed over the section of the fluidized bed, are directed towards the inlet means 9 of column 8, whose upper part is contained in cyclone 7, substantially at the level of zone 7*b*.

The cooling particle inlet 9*a* in column 8 and outlet in column 8*a* are preferentially of beveled shape adapted to a high velocity of the hydrocarbon vapors introduced tangentially to the particle flow. This arrangement avoids to a major extent the dispersion of the cold particles outside the cooling zone. Moreover, the particles flowing by gravity from the gutters are speeded up by the vapors of effluents entering the reaction zone at a high velocity, which favors a quick and homogeneous contact of the vapors with the cooling particles.

EXAMPLES

The following examples are given to illustrate the invention and particularly the possibility of catalytic treatment of the effluents in the cooling loop. They must not be considered as limiting in any way the scope of the invention.

EXAMPLE 1

With inert cooling particles

Butane has been subjected to steam-cracking. The operating conditions and experiment results are reported in the following table.

EXAMPLE 2

With inert cooling particles and with catalytic particles

The same charge has been subjected to steam-cracking substantially in the same operating conditions. Catalytic particles were added to the cooling solid particles in order to perform the metathesis of ethylene and of 2-butene for obtaining propylene. The operating conditions and the experiment results are reported in the following table.

TABLE

| | Example 1 | Example 2 |
|---|---|---|
| Charge | $C_4H_{10}$ | $C_4H_{10}$ |
| Inert particles | Carborundum | Carborundum |
| Density (kg/m$^3$) | 2 500 | 2 500 |
| catalyst particles | — | Tungsten oxide on silica (15% b.w) |
| Density (kg/m$^3$) | — | 1 700 |
| Specific surface of the inert particles (m$^2$/g) | 0.2 | 0.2 |
| Specific surface of the catalyst particles (m$^2$/g) | — | 170 |
| Size of inert particles | 260 microns | 260 microns |
| Size of catalyst particles | — | 150 microns |
| % b.w. of catalyst particles in the cooling loop | 0 | 45 |
| Pressure (mPa) | 0.15 | 0.15 |
| Temperature of the hot inert particles heated by means of additional fuel before injection (°C.) | 965 | 950 |
| Temperature of the cold particles before cooling (°C.) | 380 | 385 |

TABLE-continued

| | Example 1 | Example 2 |
|---|---|---|
| Steam-cracking temp. (°C.) | 823 | 819 |
| Cooling temperature (°C.) | 495 | 505 |
| Residence time(s) | 0.37 | 0.39 |
| Yield | | |
| $H_2$ | 1.3 | 1.2 |
| $CH_4$ | 15.0 | 15.3 |
| $C_2H_4 + C_2H_6$ | 49.0 | 46.5 |
| $C_3H_6$ | 8.1 | 14.7 |
| $C_3H_8$ | 7.9 | 7.6 |
| $C_4$ | 12.4 | 7.5 |
| $C_5$ (<200° C.) | 6.0 | 6.7 |
| others (>200° C.) | 0.3 | 0.5 |

what is claimed as the invention is:

1. A process for steam-cracking, in a fluid bed reaction zone, of a hydrocarbon charge containing at least two carbon atoms per molecule, comprising (1) heating said charge in a reaction zone by contact with hot solid particles, said heating step giving a first gas effluent, and further comprising (2) cooling said effluent by contact with cooling particles in a cooling zone, wherein said reaction zone comprises at least one enclosure having a central axis and an internal periphery, and a mixture of said charge, which is at least partly vaporized, is circulated with steam at the internal periphery of said enclosure, wherein said mixture is contacted with said hot solid particles, said particles being heated to a temperature $T_1$ from 500° to 1,800° C., said mixture and said hot solid particles circulating co-currently, whereby cracking of said charge occurs, and after mixing of at least the hot solid particles with said mixture, said hot solid particles are separated in said enclosure from at least a portion of said first gas effluent resulting from said mixing, at least a part of said effluent is fed to a cooling zone comprising a discontinuous tubular zone, the discontinuous portion being an opening into said enclosure substantially along its central axis, said effluent is contacted with said cooling solid particles which are fed through said discontinuous tubular zone, the effluent entering the discontinuous tubular zone through the discontinuous portion and the effluent is circulated through said cooling zone, the cooling particles having a temperature $T_2$ at most 800° C., said temperature $T_2$ being lower than temperature $T_1$, said cooling particles are separated from a cooled steam-cracking effluent resulting from the contact of said first effluent with said cooling solid particles, and the cooled steam-cracking effluent is recovered.

2. A process according to claim 1, wherein said hot solid particles are substantially inert particles and said cooling particles are either substantially inert or contain catalyst particles, the size of said hot and cooling particles being from about 20 to 2,000 microns and their density from about 500 to 6,000 kg/m$^3$.

3. A process according to claim 1 wherein said mixture is contacted with said hot particles in a portion of said enclosure located substantially upstream from the inlet of the cooling zone.

4. A process according to claim 1, wherein said hot particles are introduced into a stream of steam adapted to impart thereto a particle flow velocity from 10 to 80 m/s, so as to produce a helical flow of said hot solid particles in said enclosure, at least a part of said charge is introduced either upstream from the enclosure or in the enclosure so that the output velocity of the charge is in the range from 10 to 150 m/s, the amount of steam carrying said hot particles being such that the ratio by weight of the steam flow rate to the charge flow rate is from about 0.1 to 2, the mixture obtained being maintained in contact with said hot particles in said enclosure for a residence time from about 0.1 to 2.0 at a temperature $T_3$ from about 500° to 1,500° C., said hot particles are separated from said gas effluent which is fed to the cooling and optional reaction zone wherein said cooling particles are circulated in a stream of carrying gas adapted to impart to the particles a velocity from 0.5 to 10 m/s, said gas effluent being maintained in contact with said cooling particles in said cooling zone for a residence time of 0.1–100 s, at a temperature $T_4$ from 300° to 600° C., said cooling particles being separated from said second steam-cracking effluent, which is recovered.

5. A process according to claim 1, wherein said hot solid particles are subjected to at least one regeneration and optionally to at least one heating step, by means of an auxiliary fuel in a fluidized bed at a temperature from 500° to 1,800° C., in the presence of oxygen or of a molecular oxygen-containing gas, a major part of resultant regenerated particle combustion gas is separated, at least a part of regenerated solid particles is recycled to said enclosure and the hot solid particles originating from the regeneration step are at least periodically withdrawn without being fed to said enclosure.

6. A process according to claim 5, wherein said regeneration and said heating operations are performed by a first step of heating with a carrier gas in a substantially vertical elongated tubular zone whose L/D ratio (L being the tube length and D its diameter) ranges from 20 to 400, said carrier gas being at a temperature $T_5$ from 500° to 1,500° C., said carrier gas comprising oxygen or a molecular oxygen-containing gas and by a second step of regeneration and optionally of completion of the auxiliary fuel combustion, in a second zone by heating with a carrier gas comprising oxygen or a molecular oxygen-containing gas at a temperature $T_6$ higher than $T_5$ and ranging from about 700° to 1,800° C.

7. A process according to claim 6, wherein said fuel is introduced substantially at the bottom of the tubular zone.

8. A process according to claim 7, wherein said fuel is selected from the group of, straight-run residues, asphalts, petroleum cokes, coals, peats, and mixtures thereof.

9. A process according to claim 1 wherein the solid particles are selected from the group consisting of calcite, dolomite, limestone, bauxite hydroxide, chromite, magnesia, perlite, alumina and silica.

10. A process according to claim 1, wherein said cooling particles are cooled in a fluidized bed in at least one cooling area, located downstream from said cooling zone, at a temperature from about 200° to 800° C., at least a part of said cooling particles being recycled to said enclosure.

11. A process according to claim 1 wherein the temperature of the hot solid particles ranges from about 500° to 1,800° C. and that of the cooling solid particles from about 200° to 800° C.

12. A process according to claim 1, wherein said hot solid particles and said mixture of charge circulate in the same direction as said cooling particles.

13. A process according to claim 1, wherein said cooling particles further contain a catalyst (1) having a matrix which is silica, alumina, silica-alumina, zirconium oxide, or thorium oxide and (2) containing compounds of molybdenum, tungsten, vanadium, niobium, tantalum or rhenium, said catalyst amounting to 2–95% by weight of the cooling particles.

14. A process according to claim 8, wherein the coal is a lignite.

15. A process according to claim 1, wherein said hot particles and said mixture of charge circulate countercurrently to said cooling particles.

16. A process according to claim 7, wherein said fuel is a vacuum residue.

* * * * *